US007696850B2

(12) United States Patent
Stanford et al.

(10) Patent No.: US 7,696,850 B2
(45) Date of Patent: Apr. 13, 2010

(54) APPARATUS FOR APPLYING A LOAD

(75) Inventors: Peter Stanford, Queensland (AU); Dean Bradford, Queensland (AU); Michael Verity, Queensland (AU)

(73) Assignee: Triasx Pty Ltd., Murarrie (AU)

( * ) Notice: Subject to any disclaimer, the term of this patent is extended or adjusted under 35 U.S.C. 154(b) by 0 days.

(21) Appl. No.: 12/120,037

(22) Filed: May 13, 2008

(65) Prior Publication Data

US 2009/0124122 A1 May 14, 2009

Related U.S. Application Data

(63) Continuation-in-part of application No. 11/936,968, filed on Nov. 8, 2007.

(51) Int. Cl.
*H01F 27/29* (2006.01)

(52) U.S. Cl. ..... 336/192; 336/198

(58) Field of Classification Search ..... 439/578; 324/555, 624; 336/192, 198, 208
See application file for complete search history.

(56) References Cited

U.S. PATENT DOCUMENTS 2,949,591 A * 8/1960 Craige ..... 336/83
3,358,256 A * 12/1967 Naito et al. ..... 336/83
3,870,047 A * 3/1975 Gonser ..... 606/45
4,161,710 A * 7/1979 Kakurai ..... 336/192
4,352,079 A * 9/1982 Mueller et al. ..... 336/65
4,893,105 A * 1/1990 Maeda et al. ..... 336/84 M
5,600,294 A * 2/1997 Buenconsejo et al. ..... 336/192
6,336,818 B1 * 1/2002 Bayer ..... 439/78

FOREIGN PATENT DOCUMENTS

CN 201160112 Y 12/2008
WO WO 03/030416 4/2003
WO WO 2008/029522 3/2008

OTHER PUBLICATIONS

PCT International Search Report, International Application No. PCT/AU2009/000593, mailed Sep. 2, 2009 (4 pages).
PCT Written Opinion of the International Searching Authority, International Application No. PCT/AU2009/000593, mailed Sep. 2, 2009 (6 pages).
Huber+Suhner, "*RF Connector Guide*", Understanding connector technology, 4th Edition 2007.

* cited by examiner

*Primary Examiner*—Michael C Zarroli
(74) *Attorney, Agent, or Firm*—Fish & Richardson P.C.

(57) ABSTRACT

An apparatus for the application of a test load apparatus 100 is disclosed. The apparatus consists of a body 101, having an upper and lower collar 101*a*, 101*b* and a spool 102 formed therebetween. A conductive load 202 is then wound about the spool 102 with one end of the conductive load 202 being coupled to a connector 203 such that a portion of the coiled conductor is retained within a central passage provided within the body 101.

20 Claims, 7 Drawing Sheets

APPARATUS FOR APPLYING A LOAD

CROSS REFERENCED APPLICATIONS

Figure 1:
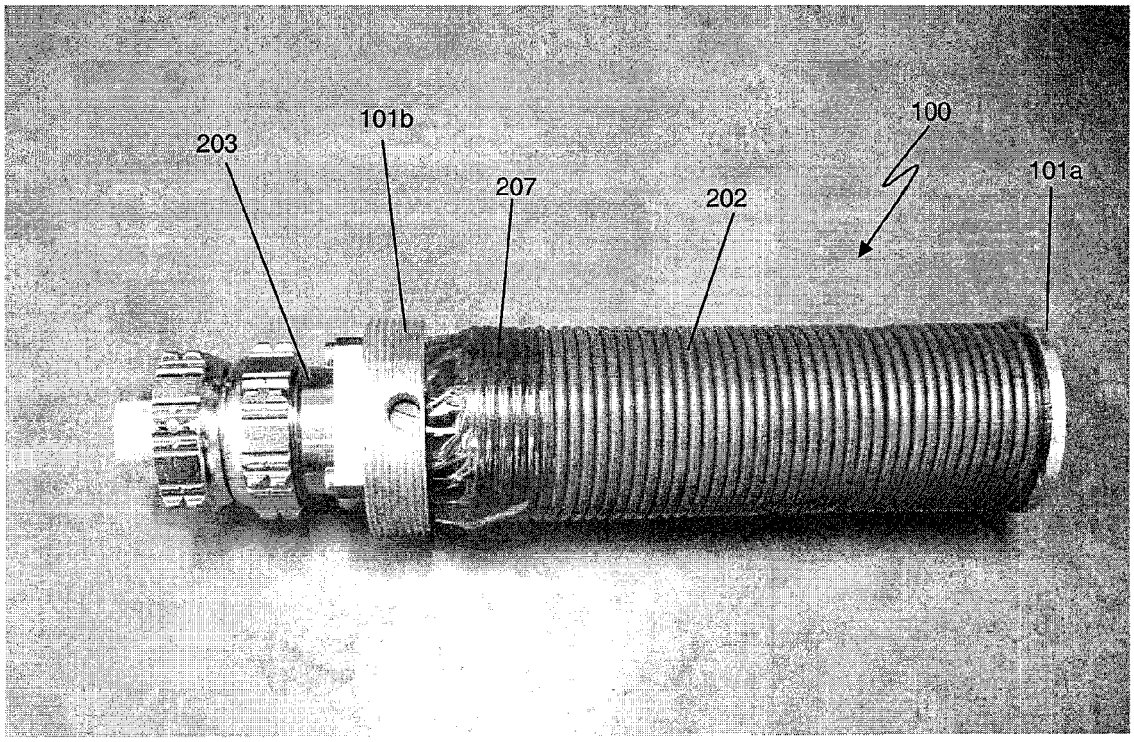

This application is a Continuation-In-Part of U.S. application Ser. No. 11/936,968 filed 8 Nov. 2007 the contents of which are herein incorporated by reference.

BACKGROUND OF THE INVENTION

1. Field of the Invention

The present invention relates generally to radio frequency communication systems. In particular although not exclusively the present invention relates to an apparatus for applying a load to a given point within a network for diagnostic purposes.

2. Discussion of the Background Art

Quality of Service (QOS) is of major importance to today's communication network providers. One of the major factors effecting QOS in most modern communication is interference. The two most appreciable forms of interference present in most communication systems result from Active and Passive intermodulation. In each case multiple transmitting frequencies combine in ways that cause interference to receiving equipment.

In the case of Active Intermodulation (AIM) interference the transmitter or receiver actively amplify interfering signals in the in the environment that cause harmful interference. Passive Intermodulation (PIM) interference is similar to active intermodulation interference except that it almost occurs exclusively in passive elements when two or more frequencies are simultaneously present. When signals $F_1$ and $F_2$ for example encounter a non-linear device they combine as follows, mF1±nF2, (m,n=1, 2, 3 . . . ) to produce interfering signals.

Presently it has been relatively difficult to test for PIM on-site. Historically the equipment required to perform the testing was rather large and cumbersome and not readily suited for in-field deployment and has been widely considered by most in the communications industry as being impractical. Typically such on-site PIM testing requires each junction, line and interconnect to be checked. Without a PIM tester on-site, this operation is extremely labour intensive, requiring a technician to physically check/remake each connection as installed, and as such is extremely costly.

To allow for on-site analysis of PIM interference along with other communication system parameters the applicant has devised a number of portable test units which are the subject of co-pending U.S. application Ser. No. 11/936,968 filed 8 Nov. 2007 and U.S. application Ser. No. 11/941,712 filed 10 Oct. 2007 the contents of which are herein incorporated by reference.

While the portable test apparatus developed by the applicant greatly reduce the time and cost involved indentifying sources of PIM interference in a communications system, a technician is still none the less required to attach a test load to a various points in order to obtain a reading for a given section of the network. Typically the test load are made from length of coiled electrical cable, such a load can be extremely bulky and unwieldy to use particularly in confined areas. In addition to this the use of different brands of cable to construct the desired load, means that the PIM tolerance for loads of similar resistance can vary greatly. This variance can affect the accuracy of the measurement of PIM interference within the system.

Accordingly the applicant has realised that there is a need for a standardised test load for the measurement of PIM interference within a communications system, which is relatively compact and easy to use.

SUMMARY OF THE INVENTION

Disclosure of the Invention

Accordingly in one aspect of the present invention there is provided an apparatus for applying a test load said apparatus including:

i) a body having at least one passage;

ii) a connector coupled to one end of the body said connector being in communication with said passage; and iii) a conductor wound about said body and coupled to said connector such that a portion of said conductor is retained within said passage Preferably the body includes a spool formed between a first collar and a second collar disposed at opposing ends of the body. The spool may include at least one niche in communication with the at least one passage and wherein said niche receives a portion of the conductor. Preferably the second collar is of a greater thickness compared to that of the first collar.

The conductor may be wound about the body such that the body's outer surface is covered in at least one layer of conductor. In the case where the body is provided with a spool, the conductor is preferably wound about the spool, such that the outer surface of the spool is covered in at least one layer of conductor. The conductor may be a co-axial cable having a length sufficient to provide a through transmission loss at the frequency of operation, of >10 dB and therefore a return loss of >20 dB. The unterminated end may be open circuit or short circuit. In both cases mechanics need to be in place to prevent the ends from fraying for example the ends could be soldered the outer braid and inner conductor strands.

The test load may be constructed such that it is provided with an RF impedance of approximately 50Ω and a minimum return loss of approximately 16 dB. Suitably the test load is constructed such that it has an operating test frequency range covering most mobile communication bands. Preferably the test load has an operating test frequency range between 800-2300 MHz. The test load may constructed such that it provides a Passive Intermodulation load of <−107 dBm at operating powers between 10 W-40 W. The test load may be utilised with operating powers up to 50 W for an average of 3 minutes with 1:4 on/off ratio provided there is sufficient cool down time between test cycles.

Preferably the passage varies in cross-sectional area along the length of said body. Suitably the cross-sectional area of the at least one passage adjacent the second collar is less than the cross-sectional area of the at least one passage adjacent the first collar.

The apparatus may further include a termination section for receiving one end of the conductor. The termination section may be a two part construction composed of a plurality of conductive elements. Suitably two part construction includes a ferrule and a connector pin. Preferably the termination section is retained within the at least one passage adjacent the second collar. The connector pin preferably shaped for complementary engagement with the connector and to accept one end of the conductor. Suitably the ferrule is sized such that the outer surface of the ferrule contacts the surface of the at least one passage adjacent the second collar. The at least one passage may be provided with one or more apertures to allow for the insertion of suitable fasteners to lock the connector pin and ferrule in place within the at least one passage.

Alternatively the termination section may be in the form of a tubular projection 700 which extends into the central passage. The projection may be a cylindrical, triangular, rectangular, octagonal, hexagonal or any suitable shaped construction. The projection may be formed integral with the base of the connector. Alternatively the projection could be formed separate to the connector and attached by a threaded engagement, snap fitting or other suitable fastening arrangement. Suitably the internal surface of the tubular projection is sized to accept the stripped end of the conductive load which may then retained within the tubular projection by a plurality suitable fixing such as an adhesive or a plurality of solider joints.

The apparatus may be provided with a protective cap which is removable securable to the connector. The cap may be tethered to the base of the connector by a suitable link member. The connector may be any suitable RF connector such as a DIN connector or the like.

A protective sheath may also be provided, the sheath being sized to fit over the body and conductor. Suitably the sheath is constructed from a rigid heat resistant material. Preferably the sheath is constructed from a suitable polymer such as PVC, CPVC, Polymethyl methacrylate or the like. Alternatively the sheath may be construed from a fibre composite material such as carbon fibre or fibre glass. The sheath may include a plurality of apertures disposed across its outer surface. Suitably the apertures are arranged in a staggered configuration.

BRIEF DETAILS OF THE DRAWINGS

Figure 2A:
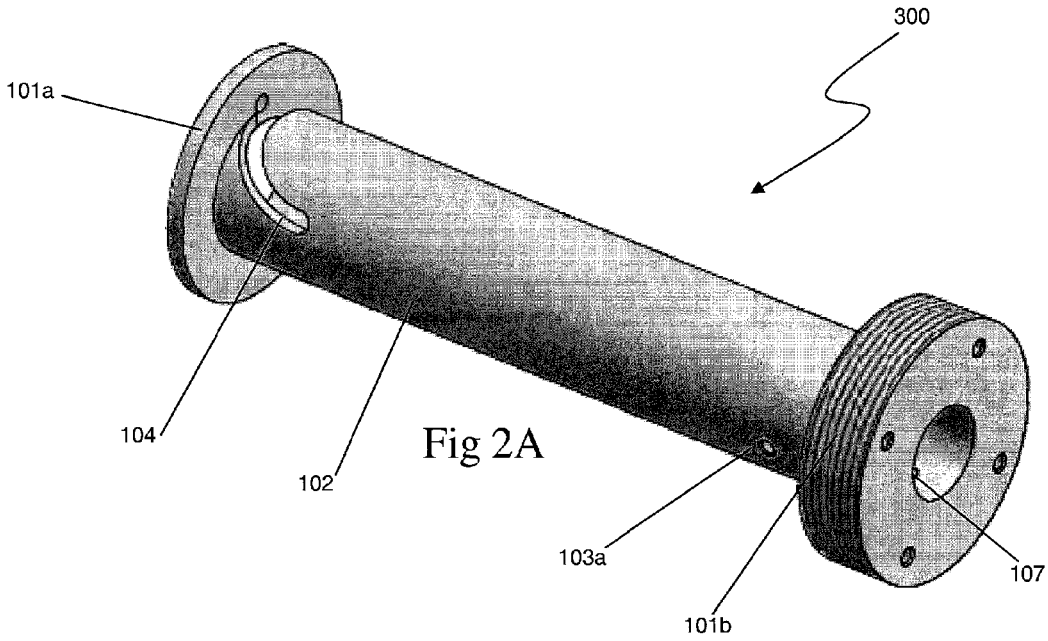
Figure 2B:
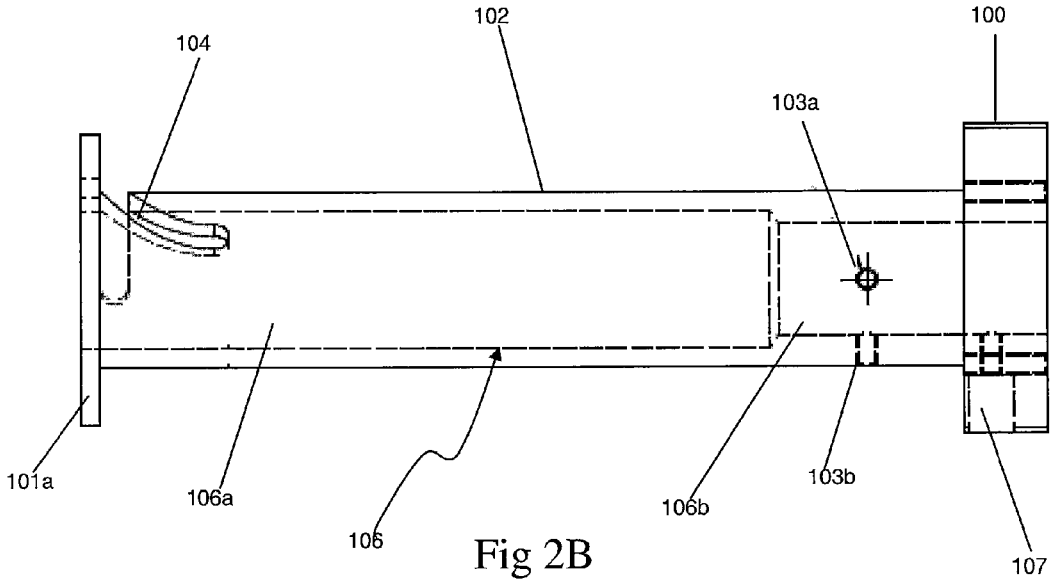
Figure 3A:
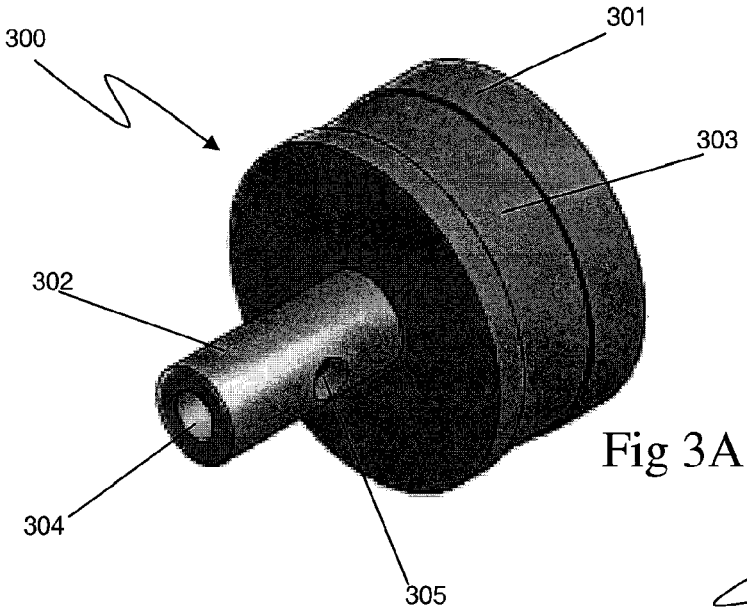
Figure 3B:
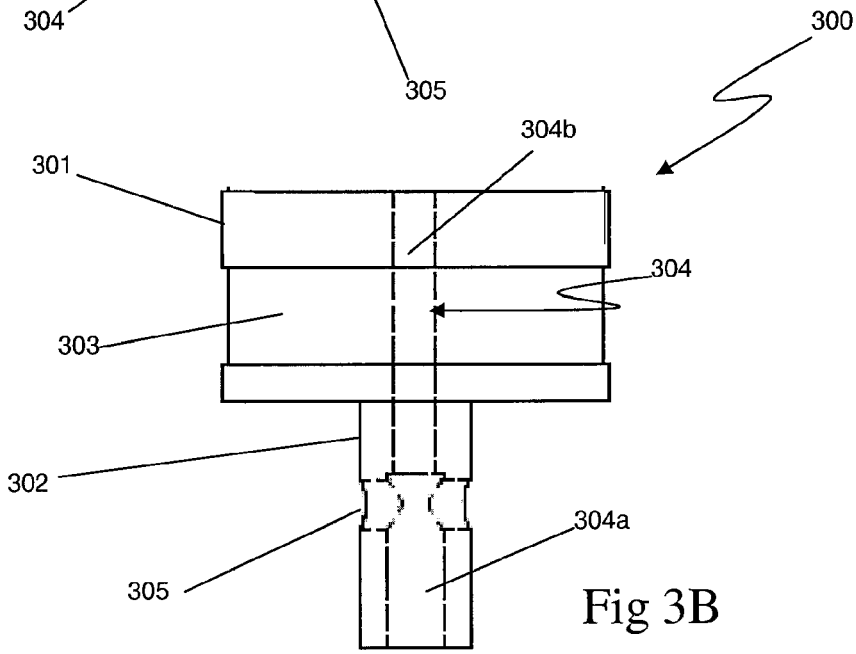
Figure 3C:
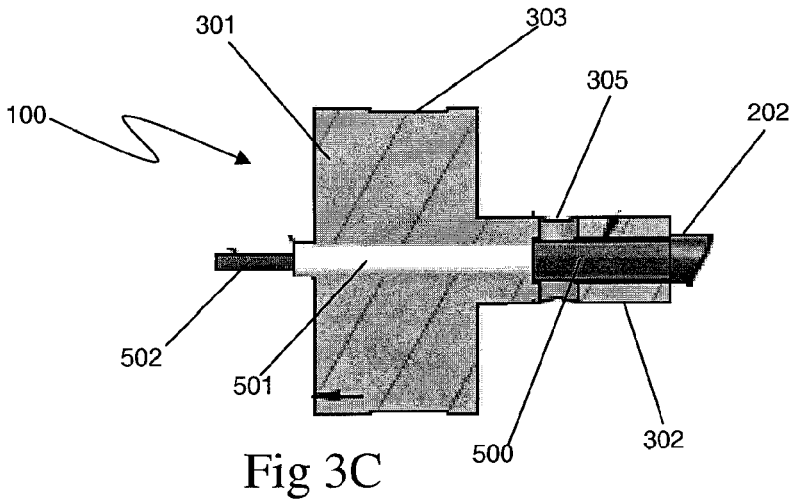
Figure 4A:
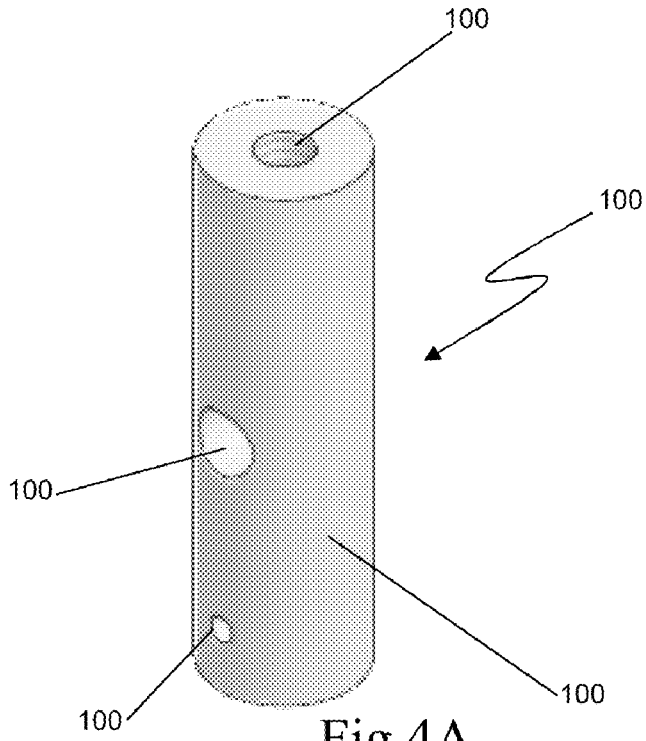
Figure 4B:
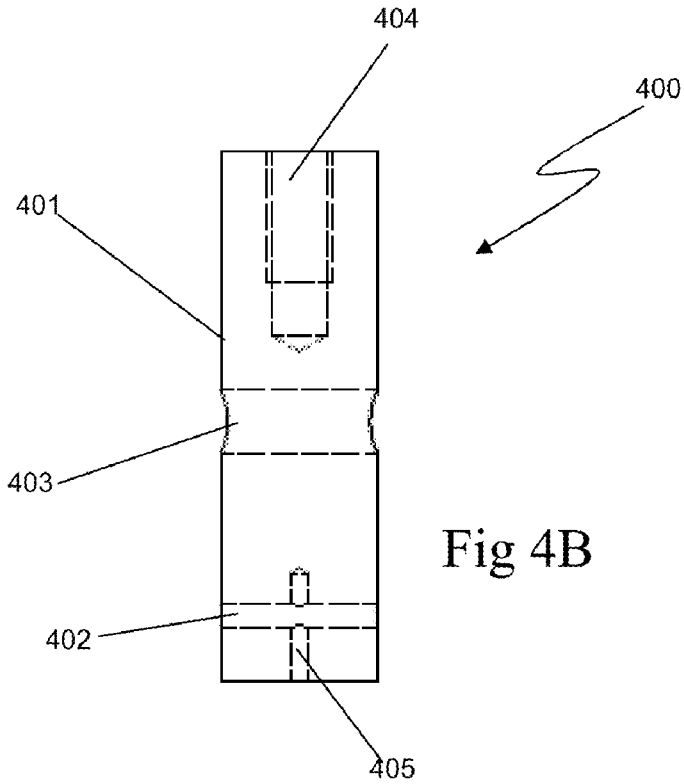
Figure 6:
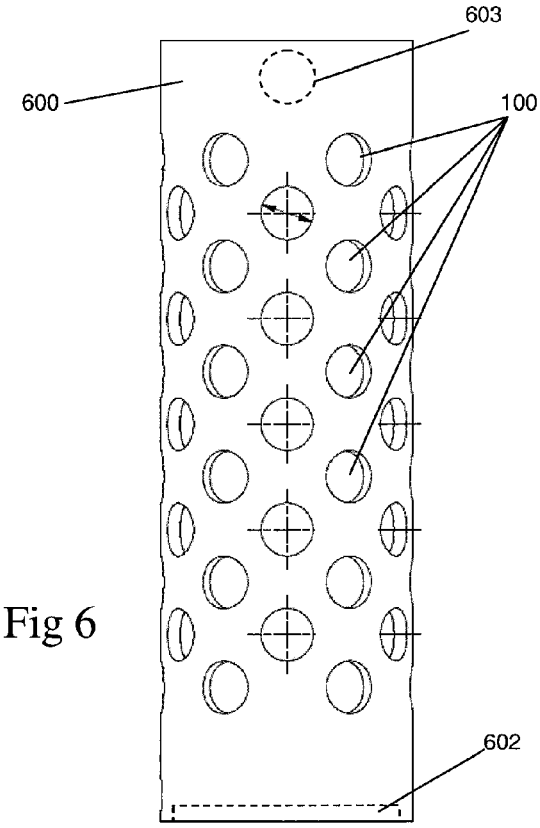
Figure 7A:
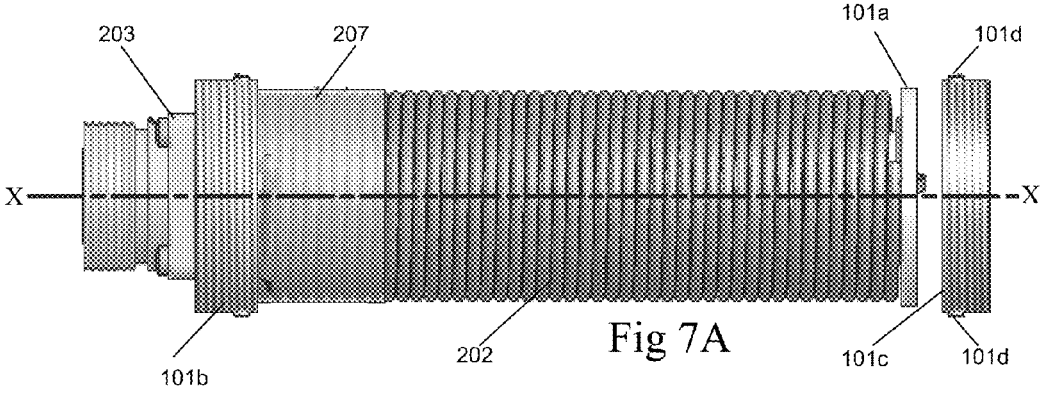
Figure 7B:
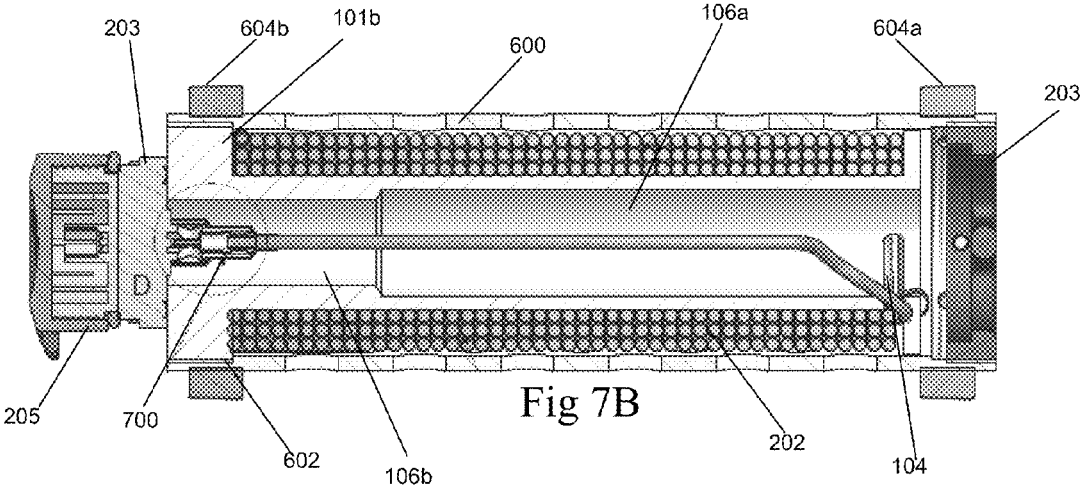
Figure 7C:
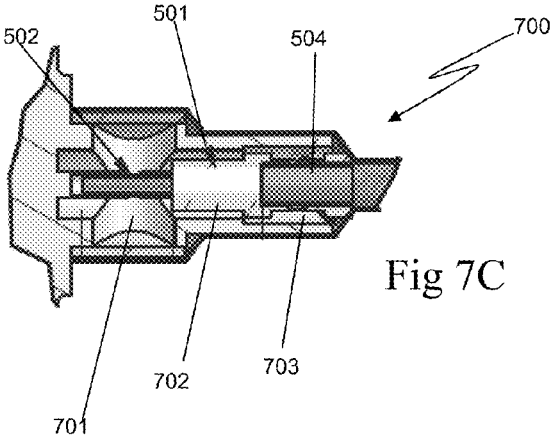

In order that this invention may be more readily understood and put into practical effect, reference will now be made to the accompanying drawings, which illustrate preferred embodiments of the invention, and wherein:

i) FIG. 1 is a photograph of the test load according to one embodiment of the invention;

ii) FIGS. 2A and 2B are schematic diagrams of the body of the test load according to FIG. 1;

iii) FIGS. 3A to 3C are schematic diagrams of a first portion of a termination section for the test load according to one embodiment of the present invention;

iv) FIGS. 4A and 4B are schematic diagrams of a second portion of the termination section for the test load according to one embodiment of the present invention;

v) FIGS. 5A to 5D are schematic diagrams showing the test load according to one embodiment of the present invention in various stages of construction;

vi) FIG. 6 is a schematic diagram depicting a protective sheath for use with the test load according to one embodiment of the invention; and vii) FIGS. 7A-7C are schematic diagrams showing the test load according to one embodiment of the present invention in various stages of construction.

DESCRIPTION OF EMBODIMENTS OF THE INVENTION

With reference to FIG. 1 there is illustrated one possible configuration of the test load apparatus 100 according to one embodiment of the present invention. The load consists of a body 101, having an upper and lower collar 101*a*, 101*b* which form a spool 102 therebetween. A conductive load 202 is then wound about the spool 102. One end of the conductive load 202 is then fed down through the body and terminates in connector 203, the remaining end of the conductor 202 is retained in position against adjacent coils by binding agent 207. The connector 203 is any suitable RF connector, in the present case the connector 203 is a standard DIN connector.

FIGS. 2A and 2B depict the body of the test load of FIG. 1 in greater detail, where FIG. 2A is a perspective view of the body 101, and FIG. 2B is a schematic view of the body 101. As shown in FIG. 2A the spool 102 includes a niche 104 disposed near the upper collar 101*a* and apertures 103*a*, 103*b* disposed near lower collar 101*b* for receipt of a retaining screws (not shown) 211*a*, 211*b*. As can be seen from both FIGS. 2A and 2B the lower collar 101*b* is of a substantially greater thickness than upper collar 101*a*, this not only provides a more stable mounting platform for the connector 203 but also enables lower collar 101*a* to act to some degree as a heat sink.

As shown in FIG. 2B the body 101 is in this particular example includes a central passage 106 which spans the length of the body 101. The central passage 106 in this particular instance has a variable cross section along the central axis X-X of the body 101. In the present example the central passage is shown as having two distinct regions of differing cross-section 106*a*, 106*b*.

Upper section 106*a* of passage 106 extends the majority of length of the body, and is of a larger diameter to that of the lower section 106*b*. The variation in the diameters between the two sections 106*a*, 106*b* provides for better ventilation of the cable termination section (which is discussed in greater detail below) housed within the lower section 106*b*. In essence the larger section 106*a* acts as an exhaust port, venting hot air from the lower section of the central passage 106.

Also shown in FIG. 2B is niche 104, apertures 103*a*, 103*b* and aperture 107. In this instance niche 104 includes a leading portion 104*a* which extends substantially parallel to the upper collar 101*a* and beyond the central axis X-X, a trailing portion 104*b* which diverges downwardly from upper collar 101*a* and extends substantially parallel to the central axis X-X. Apertures 103*a*, 103*b* are provided adjacent lower collar 101*b* and pass through into the lower section 106*b* of the central passage 106. The positioning of the apertures is such that they allow the retaining screws (not shown) in order to secure a first portion of the termination section within the lower section 106*b*. Lower collar 101*b* in this instance is also provided with an aperture 107 which passes through into the lower section 106*b* of the central passage 106. Aperture 107 allows for the insertion of a further retaining screw (not shown) in order to secure a second portion of the termination section within the lower section 106*b* of the central passage 106. It will also be appreciated that the retaining screws not only act to retain the various portions of the termination section within the lower section 106*a* of the passage 106 but also act to ground the termination section with the body 101.

As briefly discussed above the termination section in this particular instance is a two part construction, the first portion in the present example is in the form of a brass ferrule 300 and the second portion is in the form of a connector pin 400. FIGS. 3A and 3B illustrates one possible arrangement for the brass ferrule 300 according to one embodiment of the present invention.

The ferrule 300 in this instance includes a base 301 and stem 302. Base 301 is provided with a recessed section 303 which is engaged by the retaining screws (not shown) inserted through apertures 103*a*, 103*b* provided in spool 102. The stem 302 in this instance is provided with bore 305 which runs transverse to the central shaft 304 provided through ferrule 300 (see FIG. 3B). As can be seen from FIG. 3B the width of the central shaft 304 varies along the length of ferrule 300 with the upper portion of the shaft 304*a* having a larger width than that of the lower section 304*b*. The upper section 304*a* of the central shaft 304 extends the end of the stem 302 distal to base 301 to a point just beyond the transverse bore 305. The provision of bore 305 allows for the insertion of a suitable fastening device to prevent the removal of the cable 202 from the ferrule 300.

As shown in FIG. 3C the upper section 304*a* of the central shaft 304 being sized to take the cable 202 including the cladding 501 and jacket 500, while the lower section 304*b* is sized to receive the cable 202 with the cladding 501. A section of cable 202 extends beyond the base of the ferrule 300, the majority of the remaining cladding 501 is then stripped away to reveal the conductor. It this bare section of conductor which mates with the connector pin 400.

FIGS. 4A and 4B show the connector pin 400, which in this particular case is formed from a brass rod 401. The pin 400 includes a first transverse bore 402 provided adjacent the end of the pin 400 which is mounted proximate to the base 301 of ferrule 300. Also provided in the end of the pin proximate the ferrule 300 is well 405 which intersects bore 402 as shown in FIG. 4B. The well 405 is sized to accept the bared end 502 of the conductive load 202 which is then retained within the well 405 by the insertion of a suitable faster into bore 402.

A second bore 403 is provided approximately midway along the length of the pin 400. Bore 403 in this instance is provided to receive the retaining screw inserted via aperture 107 provided within the lower collar 101*b* thereby securing the pin 400 within the lower section 106*b* of the central passage 106. In addition to this retaining screw also prevents any rotation the connector pin 400, and thus any rotation of the centre conductor 204 of the connector 203 housed within the profiled socket 404 of connector pin 400.

In order to provide better electrical contact and thereby better grounding of the ferrule 300, the conductor pin 400 with the body 101 of the test load 100. Both the ferrule 300 and the connector pin 400 are silver plated.

Figure 5A:
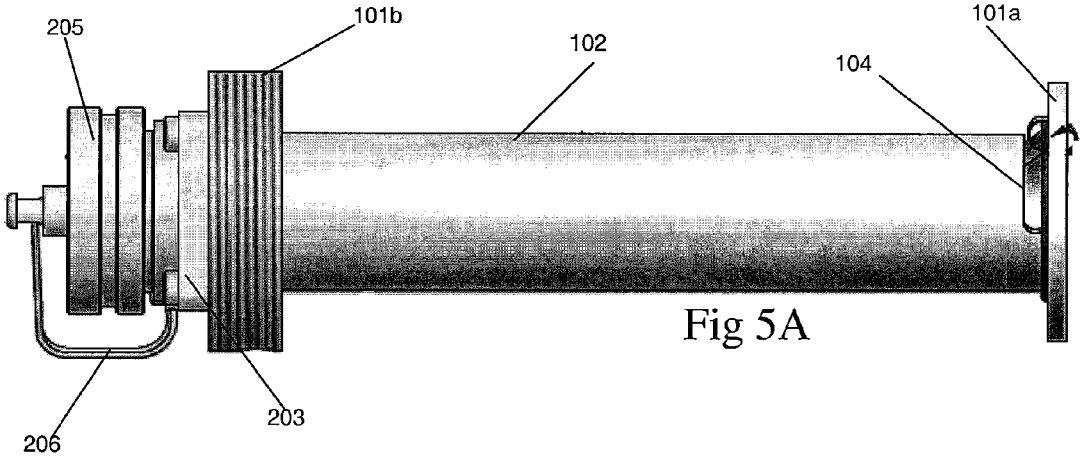
Figure 5B:
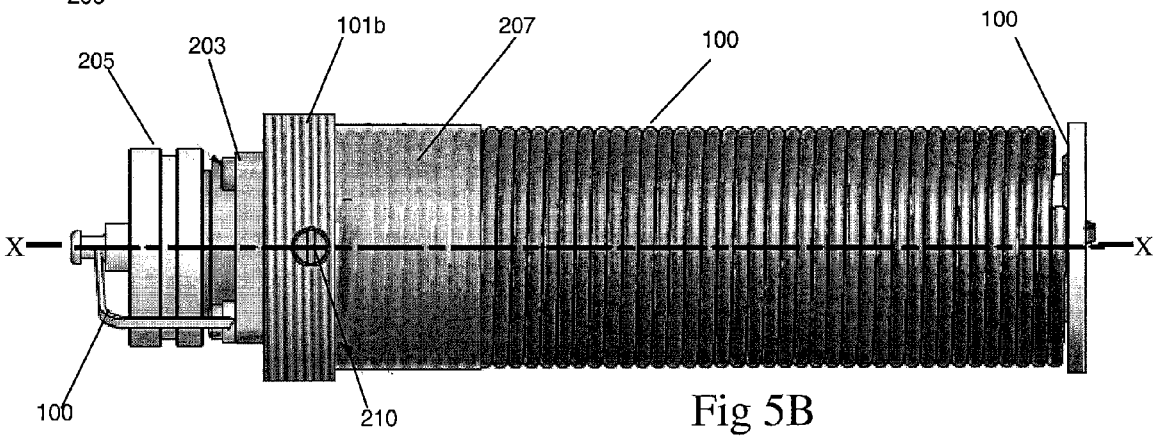

With reference to FIG. 5A there is illustrated a partially completed assembly of the test load 100 according to one embodiment of the invention. Here the connector 203 has been attached to lower collar 101*b*. Fitted to connector 203 is a protective cap 205 which tethered to the base of the connector 203 via link 206. FIG. 5B shows the test load of FIG. 5A with conductive load 202 wound about spool 102 with the free end of the conductive load 202 being retained adjacent the lower collar 101*b* and adjacent turns of coiled load 202 by a suitable binding agent 207. The binding agent 207 in this case is a length of Kapton tape, but it will be appreciated by those of skill in the art the that binding agent 207 could be any suitable adhesive, cable tie or the like provided that the free end of the cable is secured so as to prevent the coiled conductive load 202 from unfurling.

Also visible in FIG. 5B is retaining screw 210 which is positioned within aperture 107 provided within lower collar 101*b*. Also shown in more detail is the interaction between link 206, cap 205 and connector 203. Here one end of the link 206 is secured to the base of the connector 203 by the fastening screw used to couple the connector 203 to the lower collar 101*b*. The opposing end of the link 206 being coupled to the top section of the cap 205 by a suitable fastening arrangement such as a clip, clinch, rivet or in the case where the cap 205 is made from a suitable plastic the end of the link 206 could be formed integral with the upper section of the cap 205.

Figure 5C:
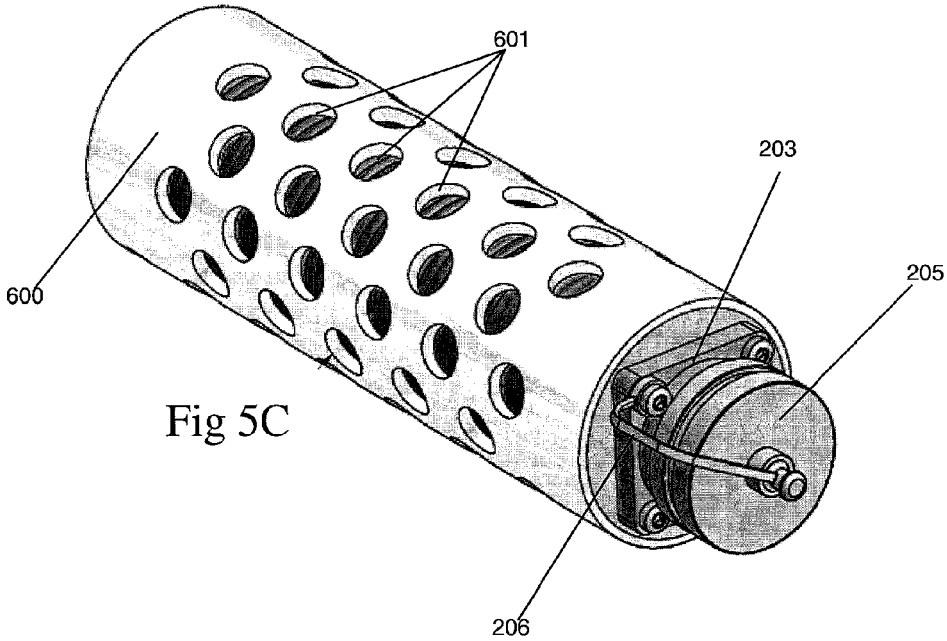
Figure 5D:
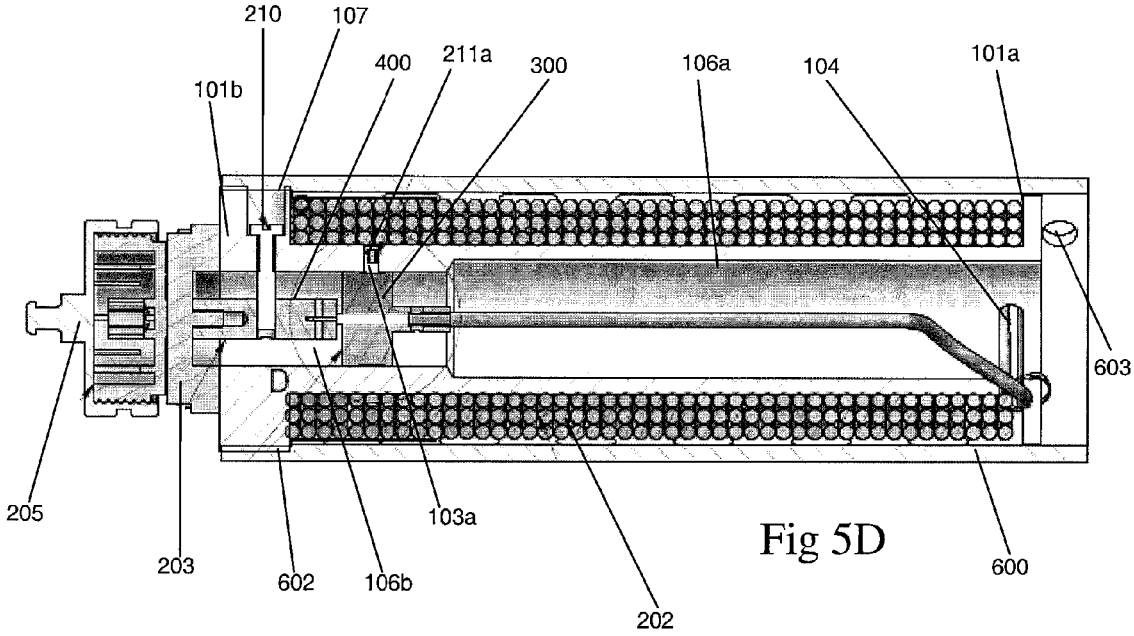

FIG. 5C shows the completed assembly of the test load 100 according to FIGS. 5A and 5B. Here a protective sheath 600 has been position over the upper and lower collars 101*a*, 101*b* and conductive load 202 coiled on spool 102. As shown sheath 600 is provided with a plurality of ventilation holes 601 which are arranged in a staggered configuration. The positioning of the sheath 600 about the body 101 of the test load 100 can be seen in greater detail in FIG. 5D which is a cross-sectional view of the test load 100 taken through the central axis X-X. As shown in FIG. 5D one end of the sheath 600 includes a recessed portion 602 which accepts the lower collar 101*b* such that the end of the sheath 600 finishes flush with the lower edge of the lower collar 101*b*. The opposing end of the sheath 600 extends past the upper collar 101*a* and in this instance includes an aperture 603 which allows for the insertion of a tool to assist in the removal of the sheath 600 during maintenance of the test load 100.

Ferrule 300 is aligned within the lower portion 106*b* of the central passage 106 such that retaining screws 211*a*, 211*b* (not shown) inserted through apertures 103*a*, 103*b* (not shown) grip the ferrule at the recessed portion 303. Connector pin 400 in this instance is suspended within the lower portion 106*b* of the central passage 106 by engagement of retaining screw 210 within bore 403. This acts to align the connector pin for engagement of with the centre conductor 204 of the connector 203.

The conductive load 202 is then feed up the central passage 106 and through niche 104 before being wound about the spool 102. The conductive load 202 in this instance has been wound around the spool 102 to provide at least three layers of conductive material in order to produce the desired resistive load. Typically the length of conductor required to produce a 50Ω load from the test load 100 discussed above is of the order of 15-20 m of cable. The cable may be any suitably shielded cable with a low PIM rating, in the case of the present example the cable is RG316 coaxial cable.

FIG. 6 is a schematic diagram showing the sheath 600 in greater detail, as mentioned above the sheath 600 is provided with a plurality of ventilation holes 601. The ventilation holes 601 are arranged in a series of rows extending along the body of the sheath 600, with adjacent rows being in a staggered relation. In the exemplified embodiment the spacing between each of the ventilation holes within their respective rows is approximately 20 mm. Suitably the sheath is constructed form a resilient heat resistant material, in the present case the sheath 600 is constructed from PVC although it will be appreciated by those of ordinary skill in the art that any other suitably polymer such as Polymethyl Methacrylate, CPVC or other rigid heat tolerant material such as carbon fibre composites, glass fibre composites and the like.

By fabricating the load in the manner discussed above the applicant can produce a test load having a standardised resistance and low PIM rating. The operating characteristics of each load can be readily verified under controlled conditions prior to field usage. Due to the robust construction of the test load the operating characteristics are less prone to change as the load is relatively protected from external environmental forces. Presently the applicant has been able to produce 50Ω loads having this construction with ratings in the order of 107-110 dBm, depending on the type of cable utilised for the conductive load. The applicant envisages the production of 50Ω loads having ratings in the order of 120 dBm is possible.

While the above discussion has focused on a test load having a single connection point the applicant also envisages the use of a load which includes an additional connector having of a similar construction to that discussed above. In this instance the upper collar would be appropriately sized to accept the additional connector. Central passage would also be modified to accept a termination section composed of a ferule and connector pin similar to that discussed above. Such an arrangement would provide for combination of male and female connectors allowing multiple test loads to be connected in series to provide greater restive loads. The use of a secondary connector would also allow for the use of 2 male or two female connectors which could allow the load to be connected in line, rather than acting simply as a terminating load. By connecting the load in line, the whole line can be tested in one pass allowing the user to identify the area of concern more quickly i.e. able to identify whether the fault occurs prior to, or after, the point at which the load is connected.

FIG. 7A depicts a partially completed assembly of the test load 100 according to a further embodiment of the present invention with conductive load 202 wound about spool 102 with the free end of the conductive load 202 being retained adjacent the lower collar 101*b* and adjacent turns of coiled load 202 by a suitable binding agent 207. The binding agent 207 in this case is a length of Kapton tape, but it will be appreciated by those of skill in the art the that binding agent 207 could be any suitable adhesive, cable tie or the like provided that the free end of the cable is secured so as to prevent the coiled conductive load 202 from unfurling. As shown the upper collar 101*a* is fitted with an endcap 101*c* and which is retained in position via grub screws 101*d*.

FIG. 7B is a cross-sectional view of the test load 100 of FIG. 7A taken through the central axis X-X. As shown in FIG. 7B one end of the sheath 600 includes a recessed portion 602 which accepts the lower collar 101*b* such that the end of the sheath 600 finishes flush with the lower edge of the lower collar 101*b*. The opposing end of the sheath 600 extends past the upper collar 101*a* and over endcap 101*c* which is secured to upper collar 101*a*. A pair of protective bands 604*a*, 604*b* may also then be positioned over the upper and lower ends of the sheath to limit potential for impact damage to the sheath 600. Also shown in FIG. 7B is an insert 606 which is positioned within the endcap 101*c* to allow for the connection of a lanyard. The insert may be retained in the endcap 101*c* by any suitable fastening arrangement such as an adhesive, threaded relation snap or bayonet fitting or the like.

A protective cap 205 may also be fitted to the connector 203. The cap 205 in this instance is formed from a suitable polymer and may be fitted to the connector via a push fit or threaded relation. The cap 205 may also include a link member (not shown) for tethering the cap 205 to the base of the connector 203 to prevent loss of the cap 205 on its removal prior to use of the load 100.

The ferrule 300 and connector pin 400 in this instance have been replaced by a tubular projection 700 which extends into lower portion 106*b* of the central passage 106. In the present example the projection is shown as a cylindrical construction but it will be appreciated that the projection could be any suitable shape such as a triangular, rectangular, octagonal, hexagonal etc construction. As shown the projection 700 formed integral with the base of the connector 203, although it will be appreciated by those of skill in the art that the projection could be formed separate to the connector and attached by a threaded engagement, snap fitting etc. The internal surface of the tubular projection 700 is sized to accept the stripped end of the conductive load 202 which is then retained within the tubular projection 700 by a plurality of solider joints.

A more detailed view of the tubular projection is shown in FIG. 7C. Here the bared end of the conductor 502 is received in the lower section 701 of the projection 700. Housed within the midsection 702 of the projection 700 is the cable 202 with the outer cladding 501, while the upper section 703 if the projection 700 house the cable 202 including the bared outer braid 504. Both the braid 504 and the bared conductor are soldered in place in order to prevent the removal of the end of the cable 202 from the projection 700.

Once the cable is secured to the projection the connector is secured to lower collar 101*b* the conductor 202 passed through passage 106 and niche 104 before being wound about the spool 102. The conductive load 202 in this instance has been wound around the spool 102 to provide at least three layers of conductive material in order to produce the desired resistive load. Typically the length of conductor required to produce a 50Ω load from the test load 100 discussed above is of the order of 15-20 m of cable. The cable may be any suitably shielded cable with a low PIM rating, in the case of the present example the cable is RG316 coaxial cable.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein.

What is claimed is:

1. An apparatus for applying a test load, said apparatus comprising:

a body having at least one passage extending through the body and along the body's central axis;

a connector coupled to one end of the body, said connector being in communication with said at least one passage; and a co-axial cable wound about said body and connected to said connector such that a portion of said co-axial cable is retained within said at least one passage, and wherein the co-axial cable is wound in a manner such that the apparatus provides a fixed characteristic impedance.

2. The apparatus of claim 1, wherein the body further comprises a spool formed between a first collar and a second collar disposed at opposing ends of the body.

3. The apparatus of claim 2, wherein the spool comprises at least one niche in communication with the at least one passage and wherein said niche receives a portion of the co-axial cable.

4. The apparatus of claim 2, wherein the co-axial cable is wound about the spool.

5. The apparatus of claim 1, wherein the apparatus further includes a termination section for receiving one end of the co-axial cable, said termination section being disposed within said at least one passage and connected to the connector.

6. The apparatus of claim 5, wherein the termination section is a two part construction.

7. The apparatus of claim 6, wherein the two part construction is composed of at least two conductive elements.

8. The apparatus of claims 7, wherein the two conductive elements comprise a ferrule and a connector pin.

9. The apparatus of claim 8, wherein the at least one passage varies in cross-sectional area along the length of said body.

10. The apparatus of claim 9, wherein the body further comprises a spool formed between a first collar and a second collar disposed at opposing ends of the body and wherein the cross-sectional area of the at least one passage adjacent the second collar is less than the cross-sectional area of the at least one passage adjacent the first collar.

11. The apparatus of claim 10 wherein the termination section is retained within the passage adjacent the second collar.

12. The apparatus of claim 1 wherein said apparatus further comprises a cap removable securable to the connector.

13. The apparatus of claim 1 wherein the connector is a DIN connector.

14. The apparatus of claim 1 wherein the co-axial cable is wound such that the body's outer surface is covered in at least one layer of co-axial cable.

15. The apparatus of claim 1 wherein the co-axial cable has a length of at least 15 m to 20 m.

16. The apparatus of claim 1 wherein the apparatus further comprises a protective sheath positioned over said body and co-axial able.

17. The apparatus of claim 16 wherein the sheath includes a series of apertures.

18. The apparatus of claim 17 wherein the apertures are arranged in a staggered configuration.

19. The apparatus of claim 16 wherein the sheath is constructed from PVC.

20. The apparatus of claim 1 wherein the co-axial cable is wound to provide a characteristic impedance of 50Ω with a minimum return loss of approximately 16 dB.

* * * * *

UNITED STATES PATENT AND TRADEMARK OFFICE

CERTIFICATE OF CORRECTION

PATENT NO. : 7,696,850 B2
APPLICATION NO. : 12/120037
DATED : April 13, 2010
INVENTOR(S) : Peter Stanford et al.

It is certified that error appears in the above-identified patent and that said Letters Patent is hereby corrected as shown below:

In column 9, line 8, in claim 16, delete "able." and insert -- cable. --, therefor.

Signed and Sealed this

Sixth Day of July, 2010

David J. Kappos

David J. Kappos
*Director of the United States Patent and Trademark Office*